United States Patent [19]

Lantermann

[11] 4,403,920

[45] Sep. 13, 1983

[54] DEVICE FOR REGULATING THE OUTPUT QUANTITY OF A COMPRESSED MEDIUM

[75] Inventor: Heinz Lantermann, Bottrop-Kirchhellen, Fed. Rep. of Germany

[73] Assignee: M.A.N. Maschinenfabrik Augburg-Nürnberg Aktiengesellschaft, Fed. Rep. of Germany

[21] Appl. No.: 267,907

[22] Filed: May 21, 1981

[51] Int. Cl.[3] ..... F04C 29/10

[52] U.S. Cl. ..... 417/295; 417/303

[58] Field of Search ..... 417/295, 290, 303

[56] References Cited

U.S. PATENT DOCUMENTS

| | | | |
|---|---|---|---|
| 2,350,896 | 6/1944 | Jde | 417/295 X |
| 3,395,856 | 8/1968 | Clark | 417/295 X |
| 4,212,599 | 7/1980 | Lantermann | 417/295 |

FOREIGN PATENT DOCUMENTS

| | | | |
|---|---|---|---|
| 1648501 | 8/1971 | Fed. Rep. of Germany | 417/295 |
| 2737677 | 3/1979 | Fed. Rep. of Germany | 417/295 |

*Primary Examiner*—Richard E. Gluck
*Assistant Examiner*—Peter M. Cuomo
*Attorney, Agent, or Firm*—McGlew and Tuttle

[57] ABSTRACT

An improved device for regulating the output a compressor arrangement in which a regulator is connected to a throttled balancing pipe interconnected between the suction and the discharge of the compressor arrangement.

2 Claims, 1 Drawing Figure

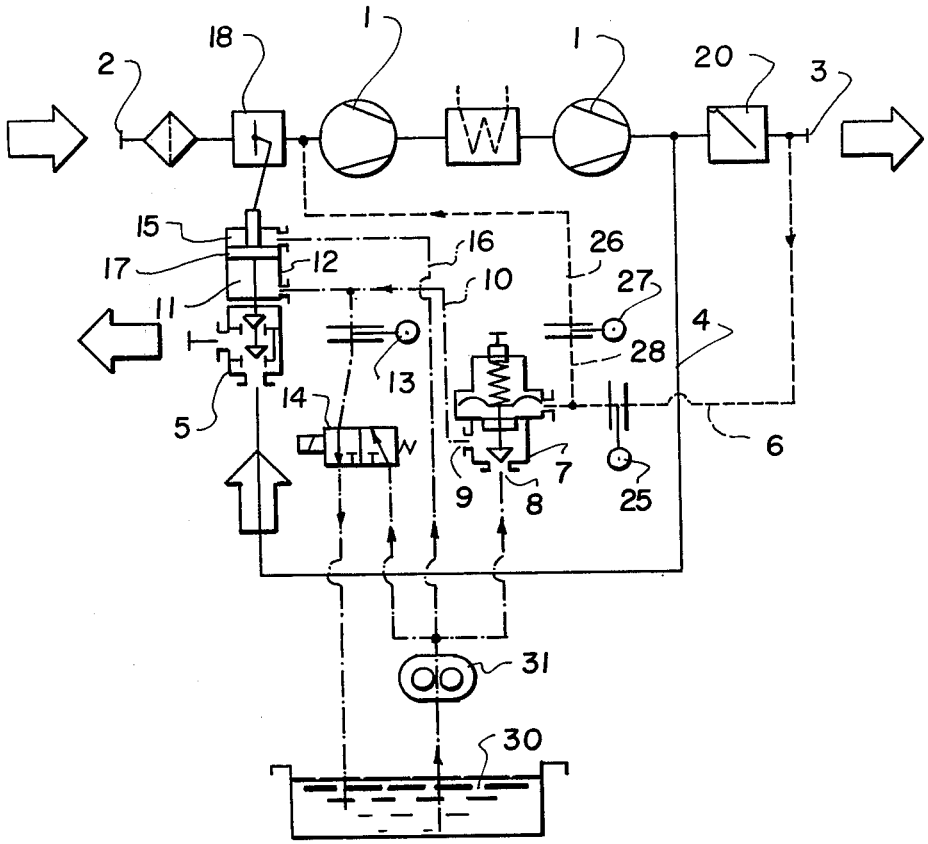
1
1
2
3
4
5
6
7
8
9
10
11
12
13
14
15
16
17
18
20
25
26
27
28
30
31

DEVICE FOR REGULATING THE OUTPUT QUANTITY OF A COMPRESSED MEDIUM

FIELD AND BACKGROUND OF THE INVENTION

The invention relates, in general to a device for regulating the output of a single or multi-stage compressor arrangement, particularly screw-type compressors of the type having a throttle valve at the suction end and a blowoff valve at the discharge or pressure end, and as well as a regulator controlling the operation of the valves which can be subjected to a control pressure through a measuring pipe connected to the pressure pipe of the compressor arrangement carrying the end pressure, and which, when the end pressure rises to within a control range, before switching to no-load operation, control the partial closing of the throttle valve to regulate the output, with the blowoff valve closed.

Such a regulating device is disclosed in West German Offenlegungsschrift No. 27 37 677, which corresponds to U.S. patent, now U.S. Pat. No. 4,212,599, the disclosures of which is incorporated herein by reference. The known device effects the regulation of the output, which adapts itself to varying amounts tapped, and works substantially without energy loss due to unnecessary blowoff. This is achieved by providing that the blowoff valve can be closed only after a leading closing angle of the throttle valve has been closed. Thus, a control range of the throttle valve is available, before this closing angle is reached, in which the output can be regulated by partially closing the throttle valve with the blowoff valve closed.

The control characteristic of the known device, however, is not optimal, since a closing operation, once it has started, is ended only when the throttling at the suction end also manifests itself in the end or discharge pressure. During transient fluctuations of the end pressure, the throttle valve can, therefore, be overdriven, that is, closed unnecessarily wide, so that fluctuations of the throttle valve, and even unnecessary opening movements of the blowoff valve can result.

West German Offenlegungsschrift Nos. 16 48 501 and 14 28 065 teach the tapping of control pressure from the suction and discharge ends for controlling adjusting elements for a throttle valve at the suction end and a blowoff or blowdown valve at the pressure or discharge end.

SUMMARY OF THE INVENTION

It is an object of the present invention to provide a device of the above-mentioned type having a more uniform control behavior.

In accordance with the present invention the measuring pipe connected to the discharge pressure end and another measuring pipe connected to the suction end of the compressor arrangement, downstream of the throttle valve are connected with each other over a throttle valve end and a balancing pipe, and the regulator is connected to the balancing pipe and works in dependence on the intermediate pressure established as a function of the throttle cross section.

It is an advantage of the inventive arrangement that, when the throttle valve begins to close, the resulting reduction of the suction pressure is acknowledged immediately to the regulator, and the closing operation of the throttle valve can be completed in time. The control pressure, sensed by the regulator, is a mixture of the intake pressure responding immediately to the position of the throttle valve, and of the end pressure influenced by the amount tapped. This results in a uniform response of the output control without overriding.

As noted above, tapping of the control pressure from both the suction end and from the pressure end of a compressor arrangement by means of the measuring pipe to control adjusting elements for a throttle valve at the suction end and for a blowoff or blowdown valve at the pressure end is known. But this is not output control, it is rather a switching between compressor operation and no-load operation, where either one or of the other control pressure is used for controlling the adjusting element, but not an intermediate pressure formed from both is not taught. Accordingly, the known arrangements do not suitably provide a uniform fluctuation free control behavior for a continuous output control, apart from the fact that this problem does not appear in switching between load and no-load operation.

Accordingly, it is an object of the invention to provide an improved device for regulating the output quantity of a gaseous medium of a compressor system of the type having at least one compressor with a suction for receiving the gaseous medium and a discharge for discharging gaseous medium, flow control means in the suction for throttling the flow of the gaseous medium to the compressor system, a control piston connected to the flow control means for actuating the throttling of the flow, a cylinder, the control piston having piston part disposed within the cylinder defining a first and second chamber on opposite sides thereof, a blowdown valve having a passage connected to the discharge and to atmosphere and valve seat means adjacent the passage, valve means connected to the control piston and movable in the passage between a position in which the valve means engages the valve seat means for closing the passage and a position in which the valve means disengages from the valve seat means for opening the passage, a reservoir for holding a liquid, pump means for pressurizing and pumping at least part of the liquid from the reservoir, conduit means connected between the pump means and the cylinder to provide a constant fluid pressure to the first chamber, a pressure regulator connected between the pump means and the cylinder for passing the pressurized liquid from the pump means to the second chamber responsive to the gaseous pressure in the discharge, the pressure regulator being connected to the discharge, a fluid throttle means between the pressure regulator and the control piston for delivering liquid to the reservoir, and the control piston being operable to open and close the passage of the blowdown valve and to actuate flow control means responsive to the fluid pressure in the first and second chambers, improvement in combination therewith including a first measuring pipe connected to the discharge, a second measuring pipe connected to the suction downstream of the flow control means, a balancing pipe interconnecting the first measuring pipe and the second measuring pipe, at least two throttle valves in the balancing pipe, and the pressure regulator being connected to the balancing pipe intermediate the said at least two throttling valves for operation responsive to an intermediate pressure established in the balancing pipe as a function of the throttle cross sections of the throttle valves.

It is a further object of the invention to provide an improved device for regulating the output quantity of a gaseous medium of a compressor system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

BRIEF DESCRIPTION OF THE DRAWING

The sole drawing is a diagrammatic illustration of a two-stage screw type compressor arrangement with the control device according to the invention.

DETAILED DESCRIPTION

A two-stage screw compressor 1 draws in the medium to be compressed, through an intake (suction) pipe 2, over a hydraulically adjustable throttle valve 18 arranged in the intake pipe, and conveys the compressed medium through an outlet pipe (pressure pipe) 3, over a check valve 20 to a supply network (not shown). A pipe 4 connects the pressure (discharge) end of the screw compressor with a hydraulic blowoff valve 5. A measuring pipe 6, downstream of check valve 20, is connected to the outlet pipe 3 to determine the variable discharge pressure. Another measuring pipe 26 is connected to the intake pipe 3, downstream of throttle valve 18, to determine the varying intake pressure. Measuring pipes 6 and 26 are connected with each other over a balancing pipe 28, which is arranged between two throttle valves 25, 27. The control medium branched off over measuring pipe 6 is thus returned into the main gas current over measuring pipe 26.

An intermediate control pressure is established in balancing pipe 28 which depends on the instantaneous value of the intake pressure and of the discharge pressure, and on the cross section of the throttle valves 25,27. The two throttle valves 25,27 can also have an adjustable throttle cross section, but once a setting for an optimum control characteristic has been found, the set cross section should not be substantially changed.

The diaphragm zone of a pressure regulator 7 is connected to balancing pipe 28. Pressure regulator 7 which releases, upon a pressure rise, as a result of reduced tapping at outlet pipe 3, the oil pressure at 8 from a pump 31 and the oil tank reservoir 30 provided for the proper functioning of a screw compressor, so that the oil flows over an outlet 9 and a pipe 10 to the lower chamber 11 of a hydraulic cylinder 12 that includes a piston 17. The piston 17 has a piston part disposed within the cylinder defining a first and second chamber on opposite sides thereof. The piston 17 operates throttle valve 18 and, with delay, also blowoff valve 5. A part of the oil is returned over shunted oil throttle 13 and open solenoid valve 14 into the oil tank reservoir 30. The upper chamber 15 of cylinder 12 is constantly supplied with pressure oil over conduit 16. The function of oil throttle 13 is to transform the rectified oil current issuing from pressure regulator 7 into an oil current moving back and forth between the lower chamber 11 and oil throttle 13. This ensures that an oil pressure is built up in the lower chamber 11 of hydraulic cylinder 12 with a rising tendency of the discharge pressure, which moves control piston 17 upward and controls throttle valve 18 in the direction of "closing."

The lower active surface of control piston 17 is larger than the upper surface. In order to prevent control piston 17 from moving upward upon a brief release of pressure oil by pressure regulator 7, thus actuating throttle valve 18 in closing direction, compensation is provided over oil throttle 13.

Blowoff valve 5 is designed as a throttle seat valve, in which two valve cones are spring-loaded against their valve seats and connected with the piston rod of piston 17 with sufficient play, e.g. over a slotted guide. An initial lifting of piston 17, and thus partial closing of throttle valve 18, therefore, does not yet result in the opening of the passage of blowoff valve 5 to atmosphere. Only when a certain lifting path of piston 17, and thus a certain closing angle of throttle valve 18 has been exceeded, is blowoff valve 5 opened, and throttle valve 18 is closed further. This can be done either by a continued increase of the control pressure in balancing pipe 28 corresponding to a continued rise of the discharge pressure at 3, or by switching solenoid valve 14 over a thermostat or a compression ratio switch when a maximum temperature has been attained in pressure pipe 3, so that the machine is switched to no-load operation by closing throttle valve 18 and opening blowoff valve 5. Switching back to load operation is effected over the lower switching point of a pressure switch.

Prior to this switching to no-load operation, that is, before blowoff valve 5 is opened, throttle valve 18 has a control range, with blowoff valve 5 closed, within which output regulation is possible by partial closing of throttle valve 18. This is done as a function of the control pressure in balancing pipe 28, which depends on the throttle cross section of throttle valves 25, 27 as well as on the variable intake pressure behind throttle valve 18 and the variable system pressure in pressure pipe 3.

With rising discharge pressure at outlet pipe 3, the control pressure in balancing pipe 28 will increase between the two throttle valves 25 and 27. Pressure regulator 7, set to this control pressure, will open and as soon as more oil is released than can flow off through oil throttle 13, it will start the closing operation of throttle valve 18. As soon as a lower pressure is established between throttle valve 17 and the low-pressure stage of compressor 1, after overcoming the play, which means a reduction in the output, this lower pressure will reduce the control pressure in balancing pipe 28 over throttle valve 27, and end the closing operation. If the end pressure should rise or fall again at 3, throttle valve 18 will further close or open, so that a continuous output regulation is possible.

The control range depends on the selection of the throttle cross sections of throttle valves 25 and 27, so that the control range can be varied by corresponding adjustment of the throttle cross sections.

Deviating from the represented embodiment, measuring pipe 26 can also be returned to the intake end of the second or a higher compressor stage of the compressor arrangement. The control device can also be used in compressor arrangements with other than screw compressors, where at least the last compressor stage, however, is preferably a screw-type compressor, in order to overcome the higher compression ratio in the above described output control.

Thus, in accordance with the invention, a device for regulating the output of a single or multi-stage compressor arrangement, particularly for screw-type compressors, with a throttle valve at the suction end and a blowoff valve at the discharge pressure end, as well as a regulator controlling their operation, which can be admitted with a control pressure by a measuring pipe connected to the discharge pressure pipe of the compressor arrangement carrying the discharge pressure, and which when the discharge pressure rises to within a control range before switching to no-load operation, controls the partial closing of the throttle valve with the blowoff valve closed, to regulate the output, characterized in that a measuring pipe 6 connected to the pressure end, and another measuring pipe connected to the suction end of the compressor arrangement 1 downstream of the throttle valve 18 are connected with each other over throttle valves 25, 27 and a balancing pipe 28, and that the regulator is connected to the balancing pipe 28 and works in dependence on the intermediate pressure established therein as a function of the throttle cross section.

While specific embodiments of the invention have been shown and described in detail to illustrate the application of the principles of the invention, it will be understood that the invention may be embodied otherwise without departing from such principles.

What is claimed is:

1. In a device for regulating the output quantity of a gaseous medium from a compressor system having at least one compressor with a suction for receiving the gaseous medium and a discharge for discharging compressed gaseous medium, the device having:

a flow control valve in the suction for throttling the flow of the gaseous medium to the compressor system;

a control piston connected to the flow control valve for actuating the throttling of the flow;

a cylinder;

the control piston having a piston part disposed within the cylinder defining a first and second chamber on opposite sides thereof;

a blowdown valve having a passage connected to the discharge and to atmosphere and valve seat means adjacent the passage;

valve means connected to the control piston and movable in the passage between a position in which the valve means engages said valve seat means for closing the passage and a position in which the valve means disengages from the valve seat means for opening the passage;

a reservoir for holding a liquid;

pump means for pressurizing and pumping at least part of the liquid from the reservoir;

conduit means connected between the pump means and the cylinder to provide a constant fluid pressure to the first chamber;

a pressure regulator connected between the pump means and the cylinder for passing the pressurized liquid from the pump means to the second chamber responsive to the gaseous pressure in the discharge, the pressure regulator being connected to the discharge;

a liquid throttle means between the pressure regulator and the control piston for delivering liquid to the reservoir; and the control piston being operable to open and close the passage of the blowdown valve and to actuate the flow control value responsive to the fluid pressure in the first and second chamber, in combination therewith, the improvement comprising;

a first measuring pipe (6) connected to the discharge;

a second measuring pipe (26) connected to the suction downstream of the flow control valve;

a balancing pipe (28) interconnecting said first measuring pipe and said second measuring pipe;

two throttle valves (25,27) in said balancing pipe; and the pressure regulator (7) being connected to said balancing pipe intermediate said throttle valves for operation responsive to an intermediate pressure established in said balancing pipe as a function of the throttle cross section of said throttle valves.

2. The improvement of claim 1 wherein the pressure regulator comprises means defining a chamber, a diaphragm closing said chamber, a valve pressure seat (8) for receiving liquid from the pump means, a regulator valve member connected to said diaphragm and movable onto said valve pressure seat, said balancing pipe connected to said chamber of the pressure regulator so that sufficient pressure from said balancing type moves said diaphragm and lifts said regulator valve member away from said valve pressure seat to establish a flow of liquid to the second chamber of the cylinder to activate the flow control valve to reduce throttling of the flow.

* * * * *

UNITED STATES PATENT OFFICE

CERTIFICATE OF CORRECTION

Patent No. 4,403,920 Dated Sep. 13, 1983

Inventor(s) Heinz Lantermann

It is certified that error appears in the above-identified patent and that said Letters Patent are hereby corrected as shown below:

On front page of patent insert the following:

FOREIGN APPLICATION PRIORITY DATA

August 25, 1980 Fed. Rep. of Germany..... 30 32 002

Signed and Sealed this

*Nineteenth* Day of *November 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,403,920

DATED : September 13, 1983

INVENTOR(S) : Heinz Lantermann

It is certified that error appears in the above-identified patent and that said Letters Patent is hereby corrected as shown below:

On the title page, Item /22/ "May 21, 1981" should read:

-- May 22, 1981 --.

Signed and Sealed this

*Nineteenth* Day of *August 1986*

[SEAL]

*Attest:*

DONALD J. QUIGG

*Attesting Officer*

*Commissioner of Patents and Trademarks*